US009920514B1

(12) United States Patent
Brekke

(10) Patent No.: US 9,920,514 B1
(45) Date of Patent: Mar. 20, 2018

(54) VALLEY TRUSS TIE

(71) Applicant: Columbia Insurance Company, Omaha, NE (US)

(72) Inventor: Steven Brekke, Lakeville, MN (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 15/261,440

(22) Filed: Sep. 9, 2016

(51) Int. Cl.

| | |
|---|---|
| ***E04B 1/41*** | (2006.01) |
| ***E04B 7/06*** | (2006.01) |
| ***E04B 7/02*** | (2006.01) |
| *E04B 1/38* | (2006.01) |

(52) U.S. Cl.
CPC ..... *E04B 1/40* (2013.01); *E04B 7/022* (2013.01); *E04B 7/06* (2013.01); *E04B 2001/405* (2013.01)

(58) Field of Classification Search
CPC ... E04B 1/40; E04B 7/022; E04B 7/06; E04B 2001/405
See application file for complete search history.

(56) References Cited

U.S. PATENT DOCUMENTS

| | | | | | |
|---|---|---|---|---|---|
| 1,846,872 | A * | 2/1932 | Isaacson | E04B 1/40 | 52/256 |
| 3,450,427 | A * | 6/1969 | Fischer | E04F 13/0855 | 403/256 |
| 3,596,941 | A | 8/1971 | Tracy | | |
| 4,291,996 | A | 9/1981 | Gilb | | |
| 4,480,941 | A | 11/1984 | Gilb et al. | | |
| 4,897,979 | A * | 2/1990 | Colonias | E04B 1/2608 | 248/248 |
| 5,004,369 | A * | 4/1991 | Young | E04B 1/2612 | 403/232.1 |
| 5,071,280 | A | 12/1991 | Turner | | |
| D327,214 | S | 6/1992 | Stuart | | |
| 5,217,317 | A | 6/1993 | Young | | |
| 5,335,469 | A * | 8/1994 | Stuart | E04B 1/2608 | 403/232.1 |
| 5,564,248 | A * | 10/1996 | Callies | E04B 1/2612 | 403/232.1 |
| 5,603,580 | A | 2/1997 | Leek et al. | | |

(Continued)

OTHER PUBLICATIONS

Simpson VTCR Single-Sided Valley Truss Clip catalog page 170, C-C 2015 © 2015 Simpson Strong-Tie Company Inc., Printed Dec. 2014, (1) pg.

(Continued)

*Primary Examiner* — Rodney Mintz
(74) *Attorney, Agent, or Firm* — Senniger Powers LLP

(57) ABSTRACT

A valley truss tie for connecting a valley truss to an underlying support truss of a roof has a front plate and a back plate connected to the front plate so the front and back plate are adjacent one another. The valley truss tie also has a fastener guidance system for holding fasteners at prescribed angles relative to the front and back plate as the fasteners are driven through the valley truss tie into the underlying support truss. The fastener guidance system has a first set of convex projections extending from a side of the front plate opposite the back plate, a second set of convex projections extending from a side of the back plate opposite the front plate, and openings in the convex projections for guiding the fasteners through the front and back plates.

19 Claims, 11 Drawing Sheets

(56) References Cited

U.S. PATENT DOCUMENTS

| | | | | |
|---|---|---|---|---|
| 6,009,681 | A * | 1/2000 | Kozloff | E04B 1/2608 403/237 |
| D422,886 | S | 4/2000 | Shea | |
| D436,311 | S | 1/2001 | Edvardsson | |
| 6,840,020 | B2 | 1/2005 | Leek et al. | |
| D640,916 | S | 7/2011 | Sias | |
| 8,443,569 | B2 * | 5/2013 | Sias | E04B 7/063 248/300 |
| 8,484,927 | B2 * | 7/2013 | Nguyen | E04B 7/063 52/714 |
| 2003/0079433 | A1 * | 5/2003 | Leek | E04B 7/063 52/712 |
| 2006/0191233 | A1 | 8/2006 | Tamlyn | |
| 2017/0009444 | A1 * | 1/2017 | Downs | B25C 7/00 |

OTHER PUBLICATIONS

Simpson Strong-Tie VTC2 Valley Truss Clip catalog p. 137, C-2009 © 2008 Simpson Strong-Tie Company Inc., Printed Dec. 2008, (1) pg.

* cited by examiner

VALLEY TRUSS TIE

FIELD OF THE INVENTION

The present invention generally relates to improvements in building construction and more particularly to connectors used to connect a valley truss to a support truss underneath the valley truss.

BACKGROUND

A valley truss is a truss used in the construction of rooves having different sections that meet at an angle, such as the case when a section of a roof extends perpendicularly from a main section of the roof. Two examples of typical usage of valley trusses in roof framing are illustrated in FIGS. 1 and 2. The valley trusses are used to form a transition between two different sections of the roof. A series of progressively smaller valley trusses 11 transition from the angular extension 15 of the roof to the main roof 17. A valley V is formed where the two roof sections meet, which is why these particular trusses are referred to as valley trusses. The valley trusses are supported by the underlying trusses 13 of the main roof section 17.

When a valley truss is set upon a support truss of the main roof, there is typically a downward sliding force due to the slope angle of the main roof (see FIG. 2) and, at times, an uplift wind force that that must be transferred into the main roof. Thus, one of the issues when connecting a valley truss to an underlying truss is that the connection must be able to resist these downward sliding forces and uplift wind forces. Traditionally, support wedges were placed under the valley truss bottom chord to help address this problem. Another traditional solution is to make a bevel cut in the bottom chord of the valley truss so the lower surface of the bottom chord matches the slope of the support truss. More recently, valley truss ties or valley truss clips have been developed to connect a valley truss to an underlying support truss of the main roof and to transfer loads from the valley truss into the support structure below. Valley truss ties are often specially designed to facilitate connection of valley trusses to the underlying support trusses over a range of slope angles.

SUMMARY OF THE INVENTION

One aspect of the invention is a valley truss tie for connecting a valley truss to an underlying support truss of a roof. The valley truss tie has a front plate and a back plate connected to the front plate so the front and back plate are adjacent one another. The valley truss tie also has a fastener guidance system for holding fasteners at prescribed angles relative to the front and back plate as the fasteners are driven through the valley truss tie into the underlying support truss. The fastener guidance system has a first set of convex projections extending from a side of the front plate opposite the back plate, a second set of convex projections extending from a side of the back plate opposite the front plate, and openings in the convex projections for guiding the fasteners through the front and back plates.

Another aspect of the invention is a building component connector for connection to one or more structural components of a building using nails received through the building component connector. The building component connector has a front plate and a back plate connected to the front plate so the front and back plate are adjacent one another. The building component connector also has a fastener guidance system for holding fasteners at prescribed angles relative to the front and back plate as the fasteners are driven through the building component connector tie into the underlying structural component. The fastener guidance system has a first set of convex projections extending from a side of the front plate opposite the back plate, a second set of convex projections extending from a side of the back plate opposite the front plate, and openings in the convex projections for guiding the fasteners through the front and back plates.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 9:
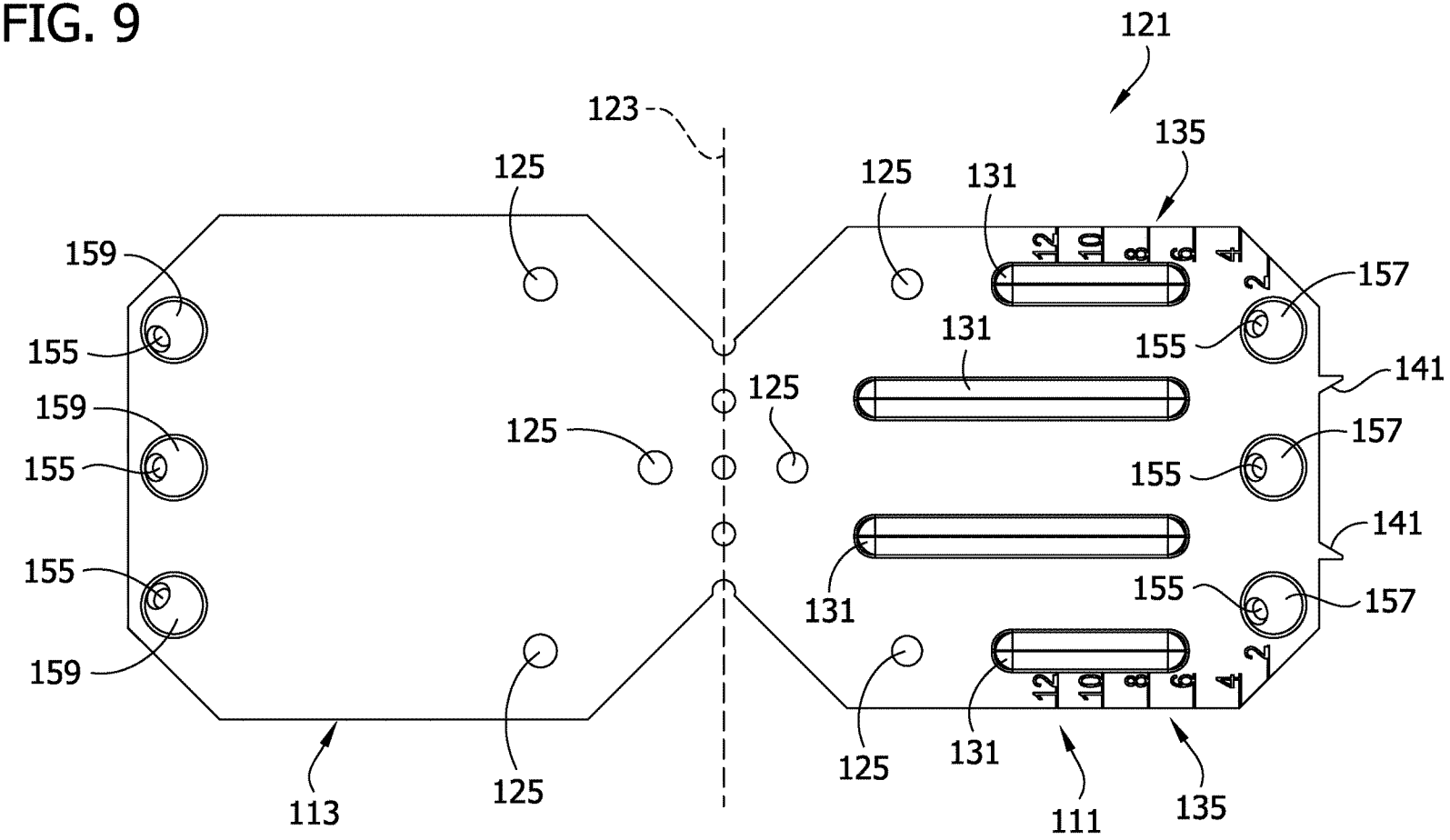
FIG. 9 is a top plan view of a blank that can be used to make the valley truss tie of FIGS. 3-8.

Referring now to the drawings, first to FIGS. 3-8 one embodiment of a valley truss tie for connecting a valley truss 103 to an underlying support truss 105 (FIGS. 10 and 11) is generally designated 101. The valley truss tie 101 (broadly, "a building component connector") has a front plate 111 connected to a back plate 113 along an upper edge of the valley truss tie. In the illustrated embodiment, for example, a plurality of material strips 115 connect the front and back places 111, 113 to one another at the top of the valley truss tie 101. The front plate 111, back plate 113, and strips of material 115 are suitably all formed as one piece of material. For example, the valley truss tie 101 is suitably made from a single sheet of metal (e.g., 18 gauge steel), such as by bending the blank 121 illustrated in FIG. 9 along the bend line 123. It is understood however, that the various parts of the valley truss tie can be formed separately and later connected to one another within the scope of the invention.

Figure 1:
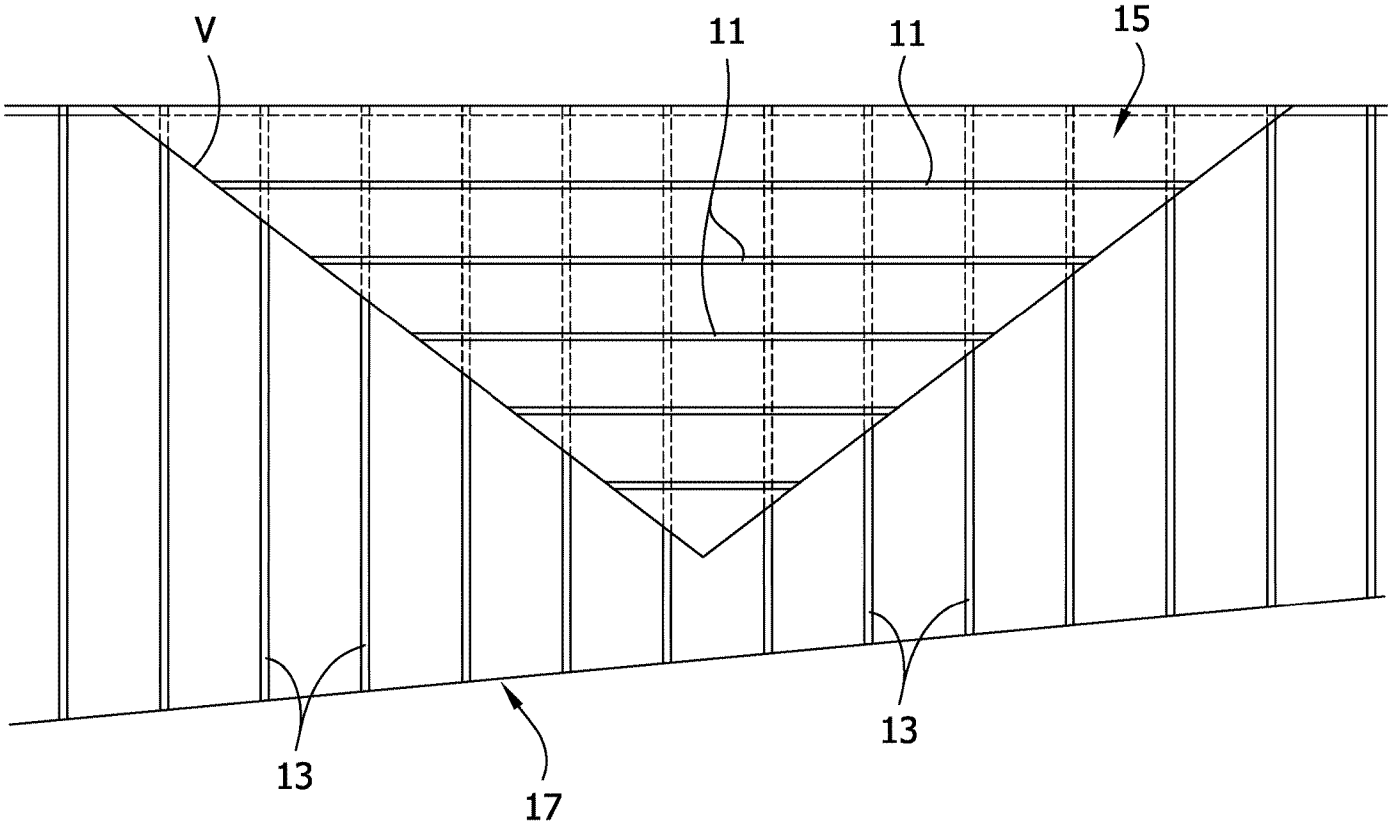
FIG. 1 is a top plan view of one embodiment of truss framing for a roof having a plurality of valley trusses.
Figure 2:
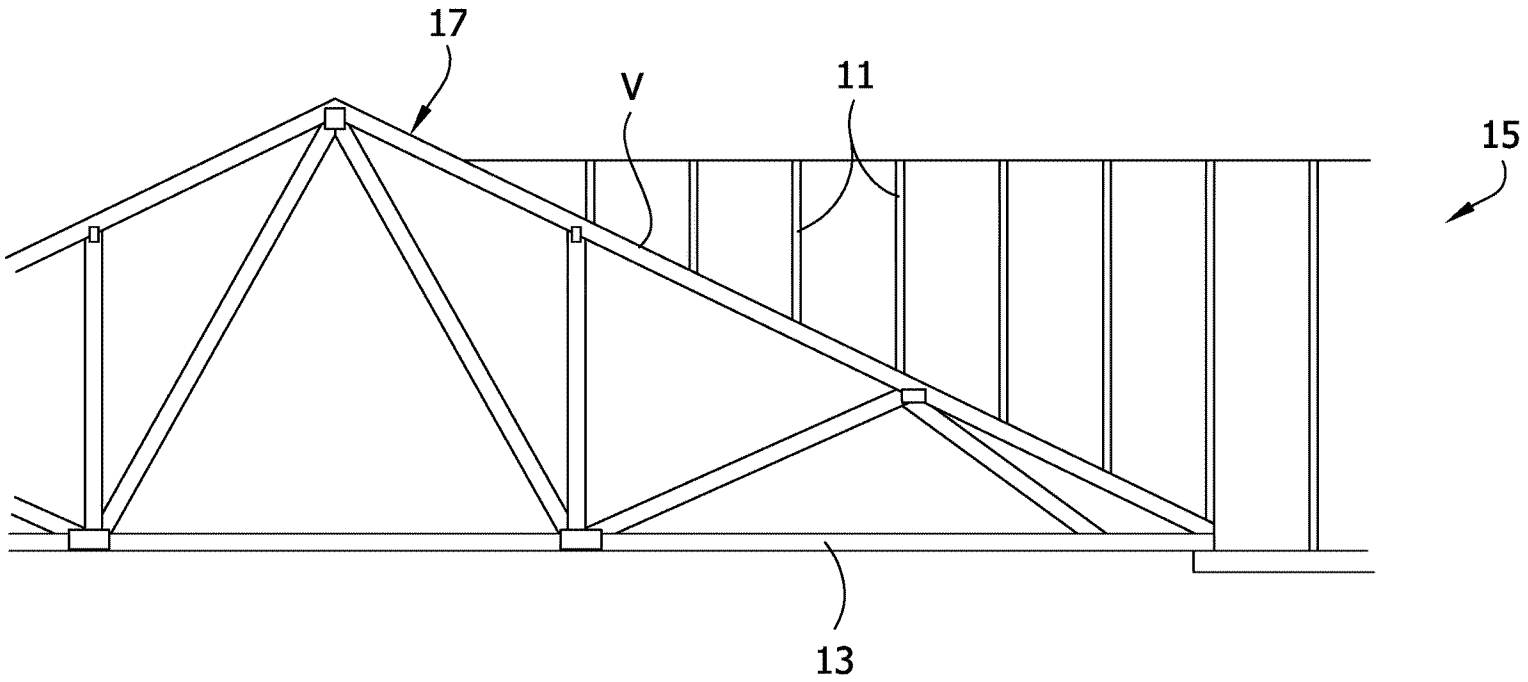
FIG. 2 is a side elevation another embodiment of roof truss framing including a plurality of valley trusses.
Figure 3:
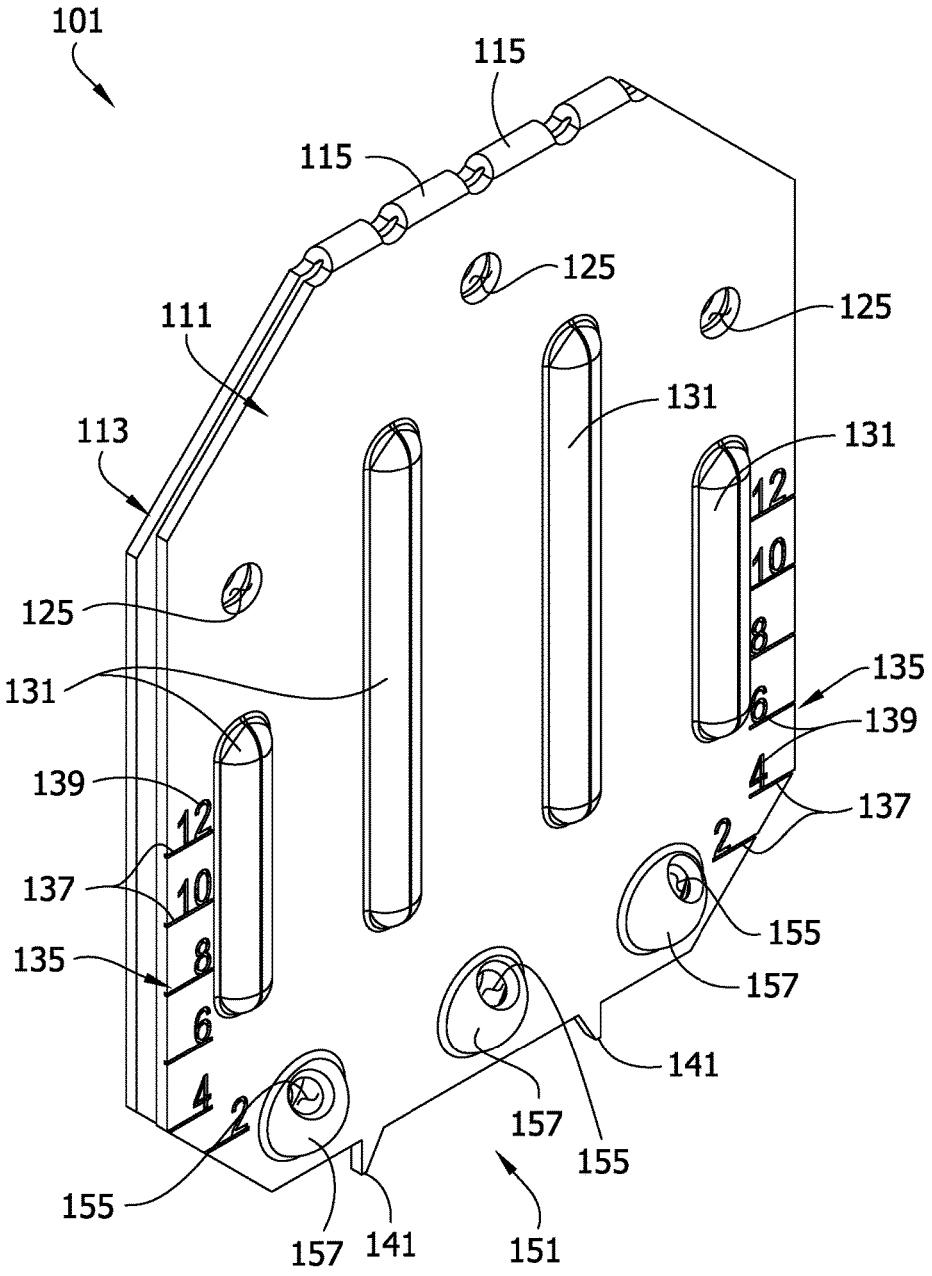
FIG. 3 is a perspective of one embodiment of a valley truss tie of the present invention.
Figure 4:
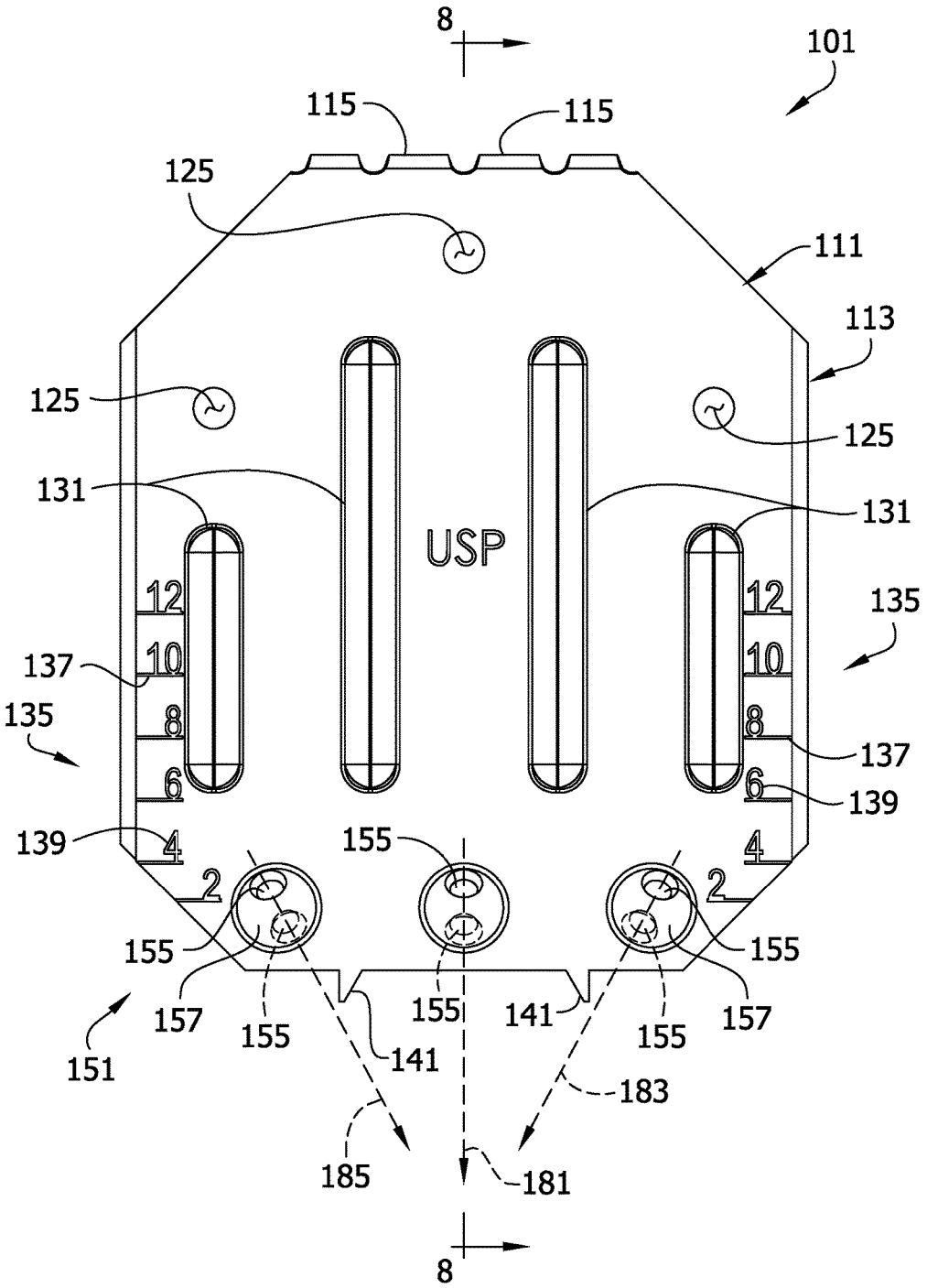
FIG. 4 is a front elevation of the valley truss tie illustrated in FIG. 3.
Figure 5:
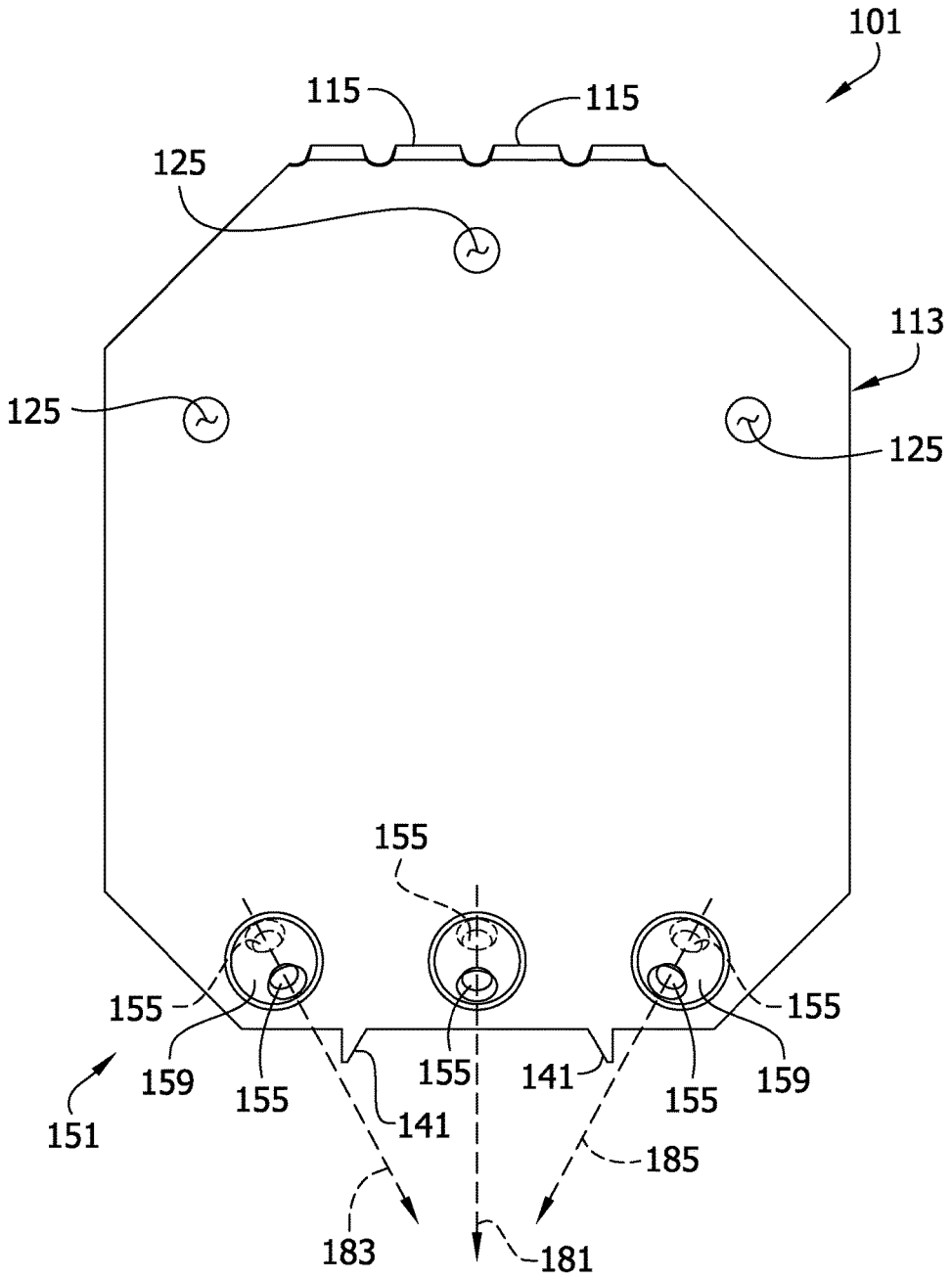
FIG. 5 is a rear elevation of the valley truss tie illustrated in FIGS. 3-4.
Figure 10:
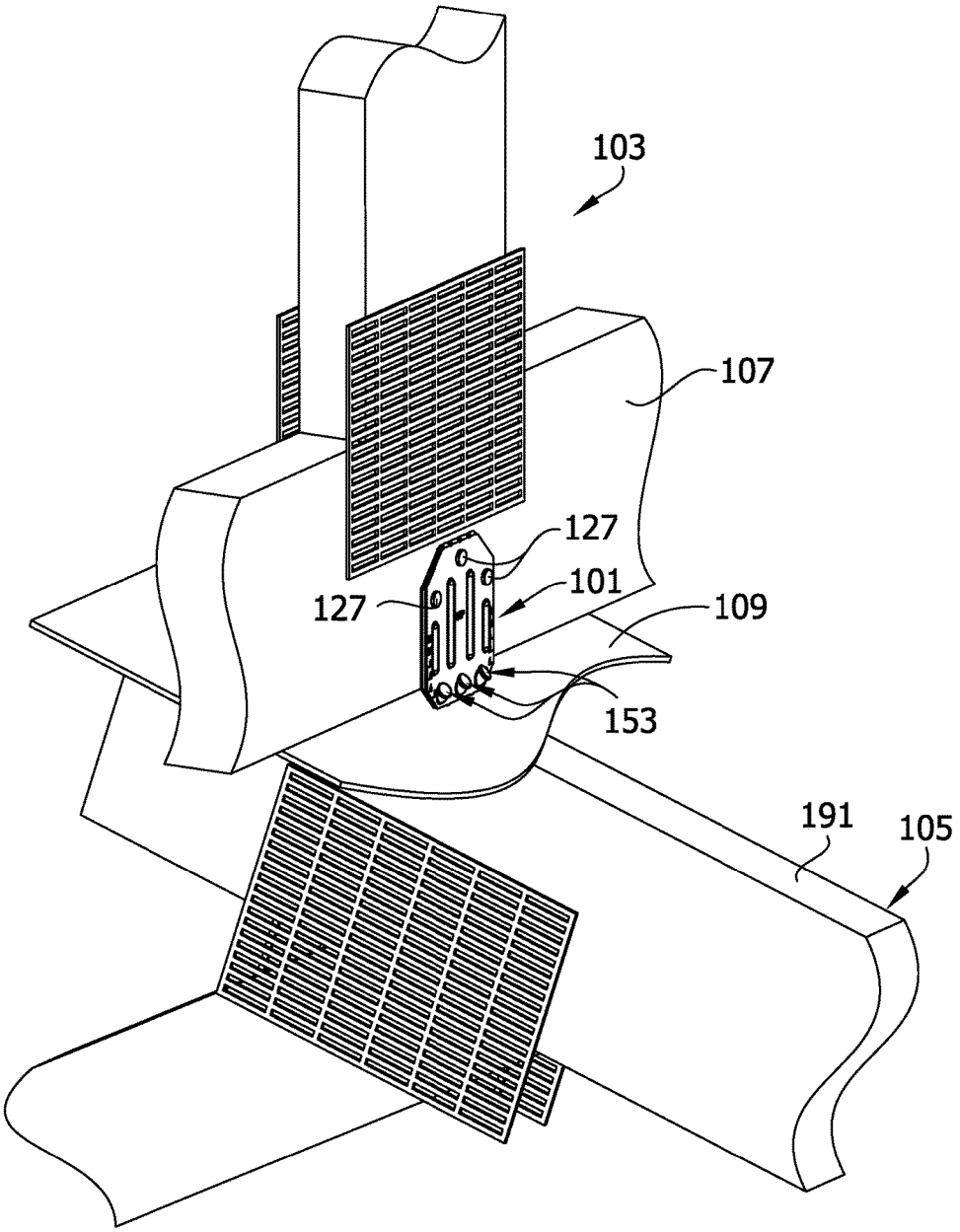
FIG. 10 is a perspective of the valley truss tie in FIGS. 3-8 connecting a valley truss to an underlying support truss.
Figure 11:
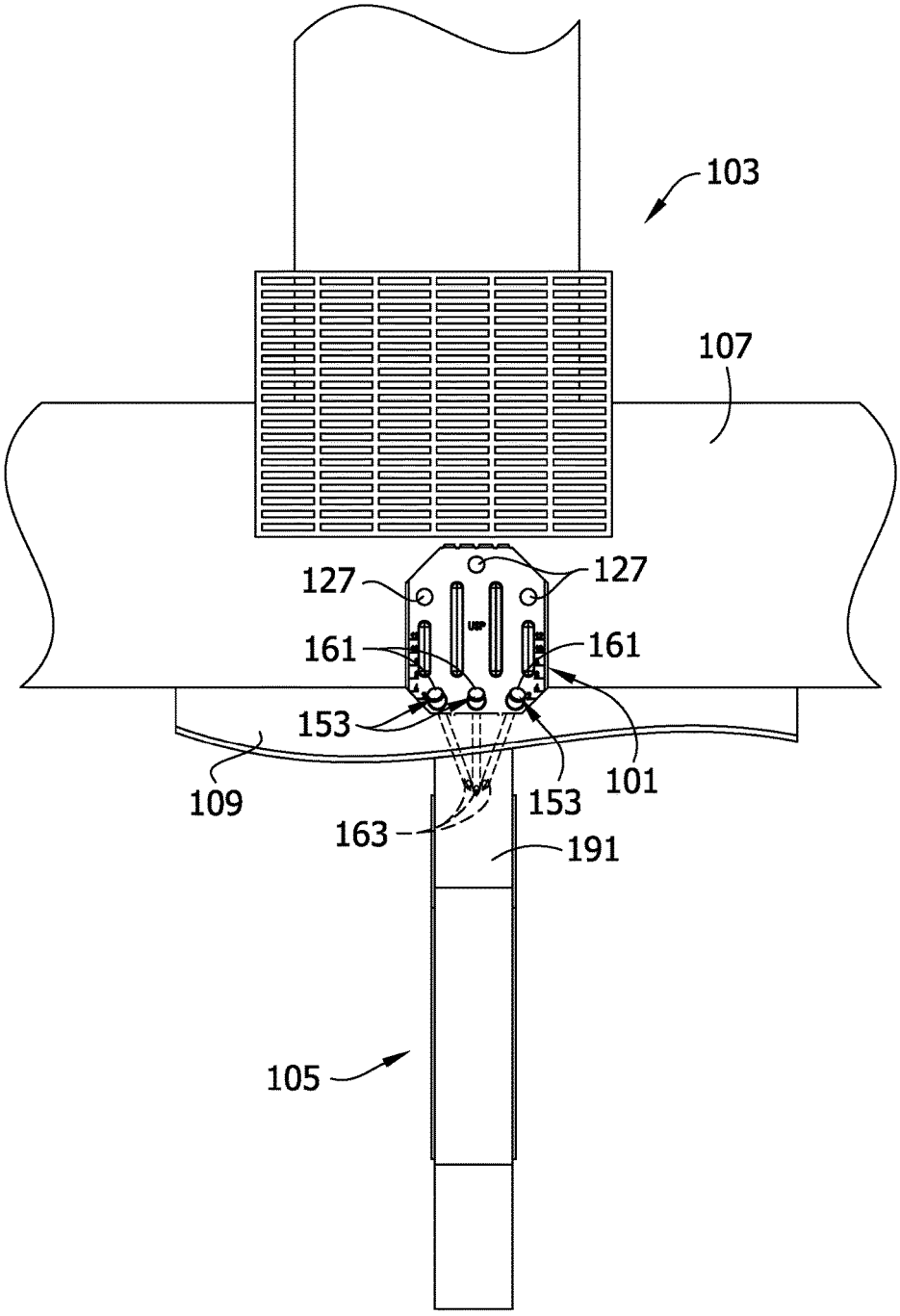
FIG. 11 illustrates a front elevation of the connection made by the valley truss tie of FIGS. 3-8 to secure the valley truss tie to the underlying support truss, as illustrated in FIG. 10.

Referring to FIGS. 3-6 and 8, the front and back plates 111, 113 have a plurality of aligned openings 125 for fasteners 127 (e.g., nails) to secure the valley truss tie 101 to the down-slope side of the bottom chord 107 of the valley truss 103, as illustrated in FIGS. 10 and 11. The openings 125 are suitably positioned in the upper half of the valley truss tie 101. The facilitates securing the valley truss tie 101 to the valley truss 103 in a position so that a lower portion of the valley truss tie overhangs the lower edge of the bottom chord 107 of the valley truss. The openings 125 are formed in portions of the front and back plates 111, 113 that are substantially flat. Further, the openings 125 are suitably arranged so that the fasteners 127 can pass through corresponding openings in the front and back plate 111, 113 at an angle that is substantially orthogonal to both the front and back plate, as illustrated by the arrow A1 on FIG. 6. Referring to FIGS. 4 and 5, the openings 125 suitably include openings at multiple different lateral positions and openings at multiple different vertical positions. In the illustrated embodiment, for example, the openings 125 include at least three openings arranged in a triangular pattern in which a middle one of the openings is positioned higher than the other openings.

The front plate 111 also includes a plurality of stiffeners 131 that increase the resistance of the front plate 111, and therefore the entire valley truss tie 101, to bending. Referring to FIGS. 3 and 4, in the illustrated embodiment, the stiffeners 131 are a plurality of vertically extending ribs formed in the front plate 111. For example, suitable ribs 131 can be formed by stamping the ribs into the front plate 111 during manufacture of the valley truss tie 101. The illustrated embodiment includes four ribs 131, including a first set of relatively longer ribs positioned between a second set of relatively shorter ribs.

The front plate 111 of the valley truss tie 101 suitably includes various features that facilitate positioning of the valley truss tie in a suitable position on the valley truss 103. Referring to FIG. 4, for example, the front plate 111 includes a plurality of prong teeth 141 extending from a lower edge of the front plate. For example, the valley truss tie 101 illustrated in the drawings has two prong teeth extending down from the bottom of the front plate 111. The prong teeth 141 are configured to stick a short distance into the underlying truss 105 (or at least into the sheathing 109 thereon) to help hold the valley truss tie 101 in position while it is secured to the bottom chord 107 of the valley truss 103 (e.g., by driving nails 127 or other suitable fasteners through the openings 125). This can help workers secure the valley truss tie 101 to the valley truss 103 when the valley truss is in position on top of the support truss 105.

The valley truss tie 101 also has a pitch guide 135 on the front plate 111. The pitch guide 135 suitably includes a series of markings 137 (e.g., horizontal lines) along a side of the front plate 111 and a series of numbers 139 corresponding to the markings. As the slope of the underlying truss 105 increases, the valley truss tie 101 needs to be positioned lower on the down-slope side of valley truss 103 so that the valley truss tie can span the gap between the bottom chord 107 of the valley truss and the underlying support truss 105. The numbers 139 indicate a pitch angle of the underlying support truss 105 that results in the valley truss tie 101 being positioned correctly for extending from the valley truss 103 to the underlying support truss 105 when the marking 137 labelled with the pitch angle of the support truss is aligned with the lower edge of the bottom chord 107 of the valley truss 103.

In the illustrated embodiment, there are two substantially identical pitch guides 135 on opposite sides of the front plate 111. However, it is understood there could be a single pitch guide 135 extending along only one side of the valley truss tie. Also, the pitch guide can be omitted if desired. The pitch guides 135 facilitate pre-positioning the valley truss tie 101 on the valley truss 103 in the proper position for use with a particular slope before the valley truss is lifted into position on the roof at the job site. For example, the valley truss tie 101 can be secured to the valley truss 103 on the ground at the jobsite or it can be secured to the valley truss before it even arrives at the jobsite.

Referring to FIGS. 3-8, the valley truss tie 101 has a toe fastener angle guidance system 151 that guides the orientation of the fasteners 153 (see, FIG. 10) used to secure the valley truss tie, and the valley truss 103, to the underlying support truss 105. The valley truss tie 101 illustrated herein is designed to guide three fasteners 153 (e.g., nails, screws, or other suitable fasteners) into the underlying truss 105. However, it is understood that the valley truss tie 101 could be modified to facilitate use of a different number of fasteners to secure the valley truss tie to the underlying support truss 105 without departing from the scope of the invention.

The fastener guidance system 151 illustrated in FIGS. 3-8 includes a plurality of sets of openings 155 for each of the fasteners 153 used to connect the valley truss tie 101 to the underlying truss 105. Each set of openings 155 includes an opening in the front plate 111 and a corresponding opening in the back plate 113. The openings 155 are suitably positioned along the lower edge of the front and back plates 111, 113. For example, the openings 155 are suitably positioned below the stiffening ribs 131 on the front plate 111. The openings 155 of the guidance system 151 are suitably at the end of the valley truss tie 101 opposite the openings 125 for the fasteners 127 to connect the valley truss tie to the valley truss 103.

The front plate 111 has a convex (e.g., dome-shaped) formation 157 extending from the side of the front plate 111 opposite the back plate 113 for each opening 155 of the guidance system 151. Likewise, the back plate 113 has a similar convex (e.g., dome-shaped) formation 159 extending from the side of the back plate 113 opposite the front plate 111 for each opening 155 of the guidance system 151. The openings 155 and convex formations 159 on the back plate 113 are suitably positioned low on the back plate so they can be positioned beneath the lower edge of the bottom chord 107 of the valley truss 103 while the fasteners 127 secure the valley truss tie 101 to the valley truss.

The convex formations 157 on the front plate 111 are substantially aligned with corresponding convex formations 159 on the back plate at each opening 155 of the guidance system 151. The convex formations 157 on the front plate 111 extend in the opposite direction compared to the convex formations 159 on the back plate 113. Thus, there is a void space 171 (FIG. 8) between the front and back plates 111, 113 at each set of openings 155. Moreover, the openings 155 for each fastener 153 are suitably generally on opposite sides of the void space 171. The convex formations 157, 159 suitably have substantially circular perimeters. The convex formations 157, 159 suitably have smooth, continuously curving shapes (e.g., spherical shapes), except where the openings 155 are located. The void space 171 suitably has a generally spherical shape, although other configurations are possible within the scope of the invention.

Figure 6:
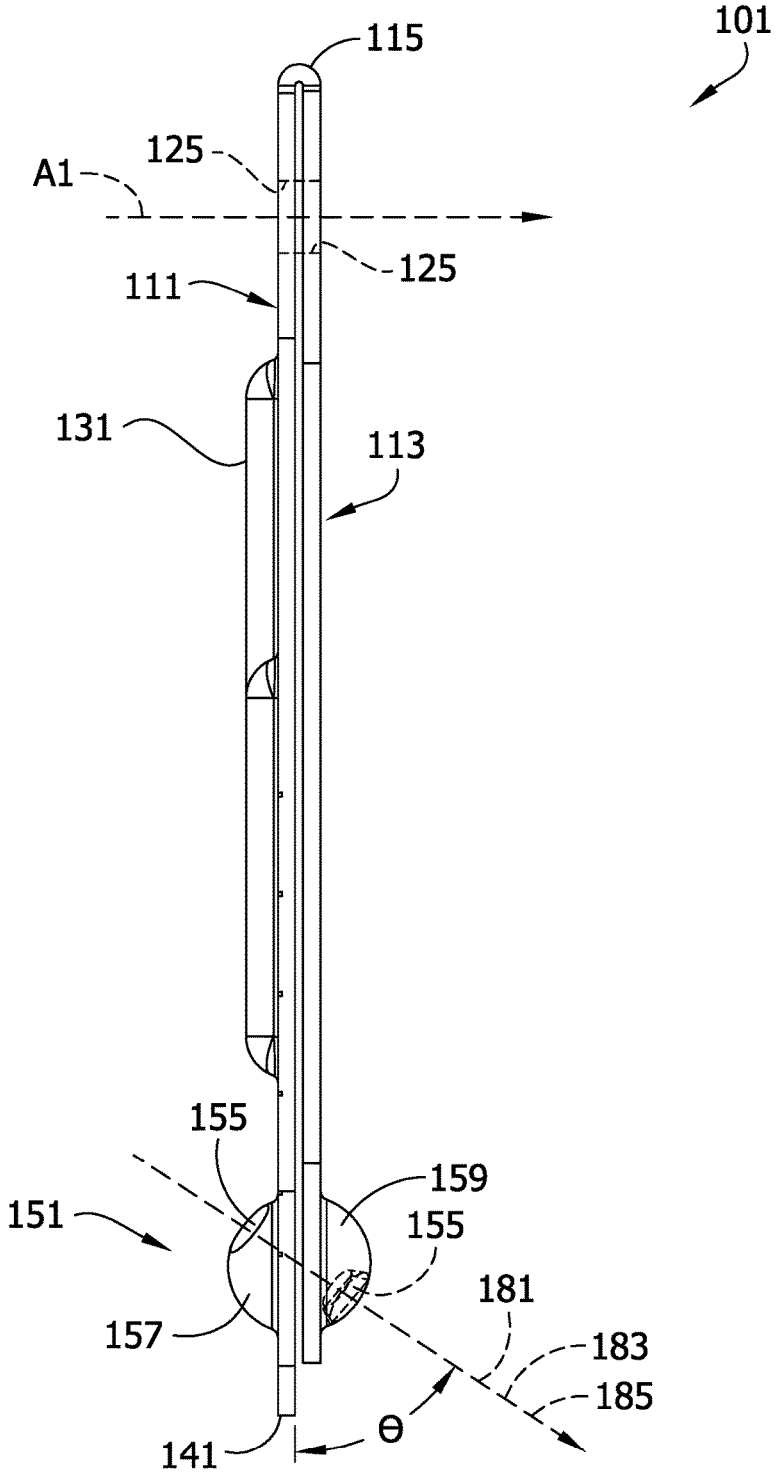
FIG. 6 a right side elevation of the valley truss tie illustrated in FIGS. 3-5.
Figure 7:
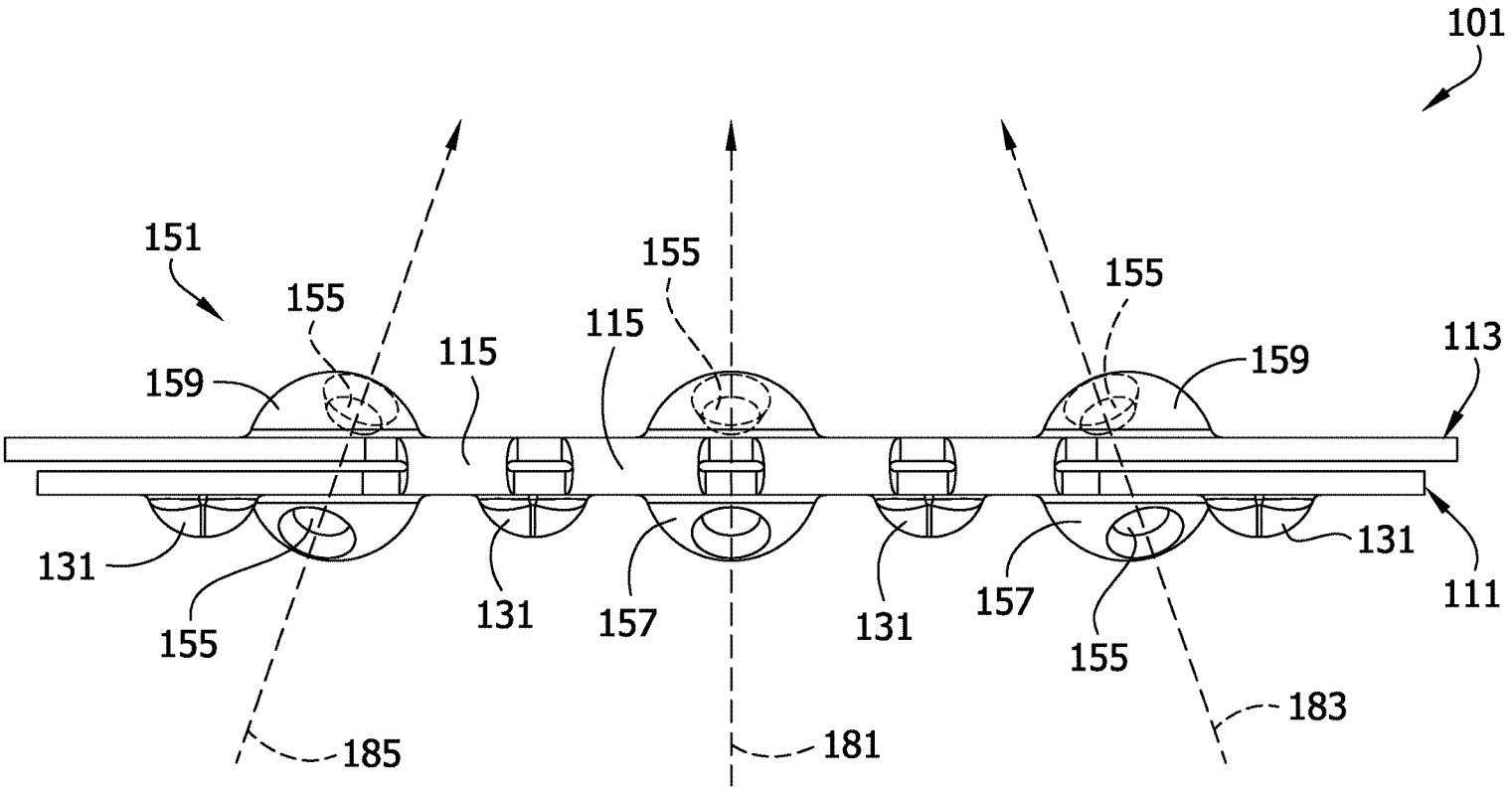
FIG. 7 is a top plan view of the valley truss tie illustrated in FIGS. 3-6.
Figure 8:
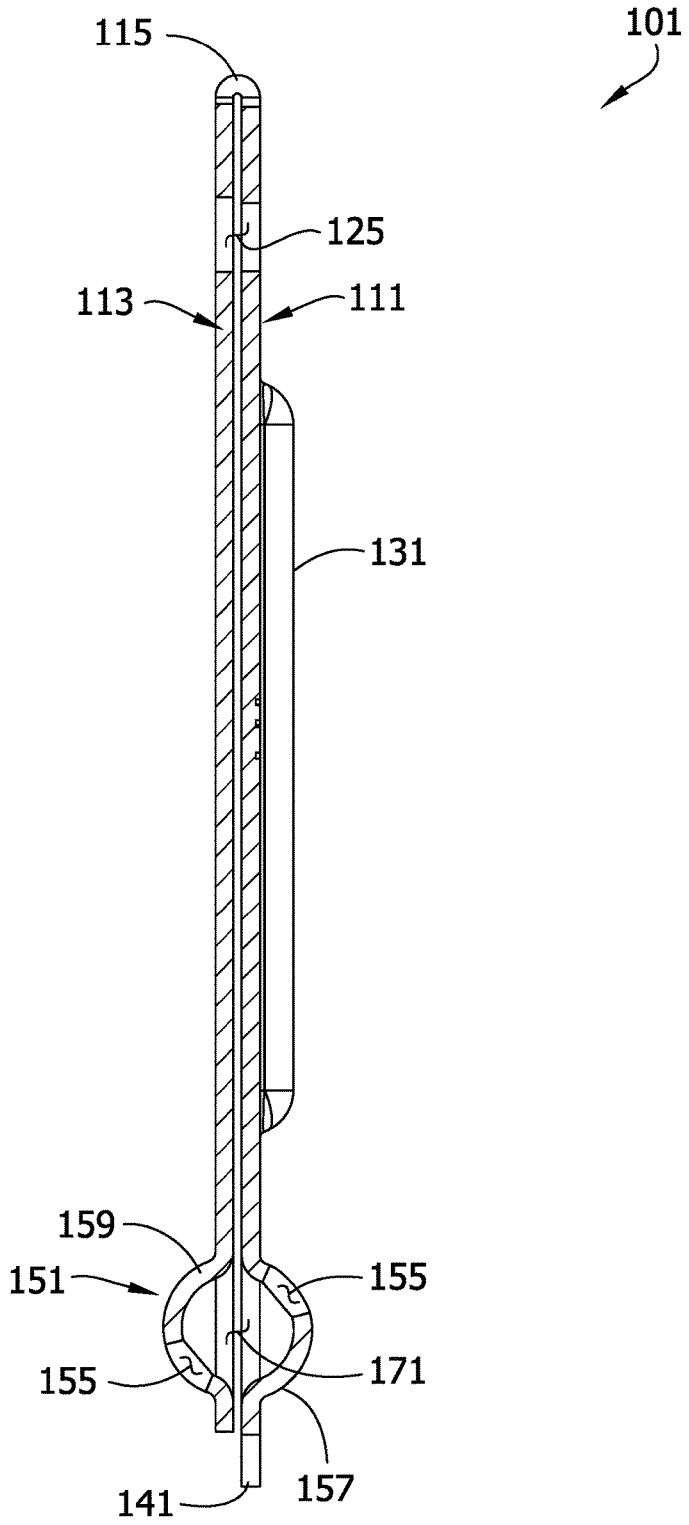
FIG. 8 is a cross section of the valley truss tie illustrated in FIGS. 3-7 taken in a plane including line 8-8 on FIG. 4.

The openings 155 in the front plate 111 for each fastener 153 are slightly offset from the corresponding openings 155 in the back plate 113. Consequently, the openings 155 of the guidance system 151 hold the fasteners 153 at predetermined angles relative to the front and back plates 111, 113. In the drawings, arrows 181, 183, 185 are used to show the predetermined angles for each set of openings 155 of the guidance system 151. Referring to FIG. 6, the openings 155 in the front plate 111 are vertically offset from the corresponding openings 155 in the back plate 113. In particular, the openings 155 in the front plate 111 are at a higher elevation than the elevation of the corresponding openings 155 in the back plate 113. Consequently, the guidance system 151 is configured to guide the fasteners 153 at a downward angle as they are driven into the underlying support truss 105 through the openings 155. All of the openings 155 of the guidance system 151 in the front plate 111 are suitably offset above the corresponding openings 155 in the back plate 113 by about the same amount. Thus, as illustrated in FIG. 6, the openings 155 of the guidance system 151 are suitably arranged to hold each of the fasteners 153 at a substantially identical downward angle θ relative to the front and back plates 111, 113 as the fasteners are driven into the support truss 105.

Referring to FIGS. 4, 5, 7, and 11, the guidance system 151 is suitably configured so the fasteners 153 are held at angles that result in the heads 161 and points 163 of at least some of the fasteners being offset laterally from one another as the fasteners are driven in to the support truss 105. Moreover, the guidance system 151 is suitably configured so the heads 161 and points 163 of at least one of the fasteners 153 has an offset that is in a different direction compared to the corresponding offset for at least one of the other fasteners 153. This causes the valley truss tie 101 to be better able to resist being pulled away from the support truss 105 by the sliding forces associated with the slope angle of the support truss or uplift wind forces. Referring to the example provided by the valley truss tie 101 illustrated herein, the guidance system 151 is suitably configured so the fasteners 153 are held at angles that result in the fasteners converging toward one another as they are driven into the support truss 105 through the openings 155. Comparing FIGS. 4 and 5, for example, the openings 155 in the front plate 111 are spaced more widely from one another than the openings in the back plate 113. The result of the differential spacing of the openings 155 on the front plate 111 compared to the spacing of the openings on the back plate 113 is that the fasteners 153 are held by the guidance system 151 so they converge toward one another as they are driven into the support truss 105.

Still referring to FIGS. 4 and 5, the openings 155 for the middle fastener 153 are not offset laterally from one another. Thus, the guidance system 151 holds the middle fastener 153 so there is no lateral offset, as indicated by the arrow 181 on FIGS. 4 and 5. Accordingly, the head 161 and point 163 of the middle fastener 153 in FIG. 11 are suitably not offset laterally from one another (assuming the fastener remains straight as it is driven into the support truss 105). On the other hand, there is a lateral offset in the sets of openings 155 for the two outer fasteners 153. Thus, the guidance system 151 is configured to hold the two outer fasteners 153 at angles that include lateral offsets, as indicated by the arrows 183, 185 in FIGS. 4 and 5. Accordingly, the heads 161 and points 163 of the two outer fasteners 153 are laterally offset from one another in FIG. 11. Moreover, the openings 155 in the front plate 111 for the two outer fasteners 153 are offset from the corresponding openings in the back plate 113 in different directions. Accordingly, the arrows 183, 185 indicating the angles at which the guidance system 151 holds the outer fasteners point in different directions. More specifically, in the illustrated embodiment, the guidance system 151 holds the outer fasteners at angles 183, 185 oriented so the outer fastener converge toward one another, and converge toward the middle fastener, as they extend from the valley truss tie 101 into the support truss 105.

To use the valley truss tie 101 the back plate 113 is placed adjacent the down-slope facing side of the bottom chord 107 of the valley truss, as indicated in FIGS. 10 and 11. This can be done while the valley truss 103 is in position on the roof or beforehand (e.g., using the pitch guide(s) to determine the correct amount the lower end of the valley truss tie should overhang the lower edge of the valley truss bottom chord). The fasteners 127 are driven into the bottom chord 107 of the valley truss 103 through the openings 125 in the upper portions of the front and back plates 111, 113 to secure the valley truss tie 101 to the valley truss 103. With the valley truss ties 101 secured to the valley truss 103 and the valley truss in position over the underlying support truss 105, fasteners 153 are driven through the openings 155 through the sheathing 109 covering the support truss and into the support truss.

Initially, the guidance system 151 helps position the fasteners 153 at multiple different predetermined angles relative to the front and back plates 111, 113. As the fasteners 153 are driven into the support truss 105, the guidance system 151 continues to guide the fasteners in the prescribed directions. In the case of the illustrated embodiment, the guidance system 151 holds and helps guide the fasteners 153 so they are driven into the truss at a downward angle. Moreover, the guidance system 151 holds and helps guide the fasteners 153 so they converge toward one another as they are driven into the support truss. The guidance system 151 holds and guides the fasteners 153 at the multiple different angles 181, 183, 185 especially well because of the fact the valley truss tie 101 can interact with each fastener at two different locations (i.e., the edges of the openings 155) spaced apart from one another on opposite sides of the void space 171. This can improve the ability of the guidance system 151 to resistance bending moments that may be applied to the fasteners 153 as they are driven into the support truss 105. It can also help ensure the fasteners 153 are driven relatively straight into the support truss 105 at the intended angles 181, 183, 185, respectively.

When the process is complete, as illustrated in FIGS. 10 and 11, the valley truss 103 is above and supported by a downwardly-sloping side 191 of the support truss 105. The back plate 113 of the valley truss tie 101 is adjacent down-slope facing side of the bottom chord 107 of the valley truss 103 and secured to the valley truss by the fasteners 127. The fasteners 153 extend through the openings 155 in the front and back plates 111, 113, through the sheathing 109, and into the support truss 105. Moreover, the fasteners 153 are all angled at different directions as they extend into the support truss 105, as illustrated in FIG. 11.

The valley truss tie 101 helps resist downward sliding forces or uplift wind forces that may be exerted on the valley truss in a number of ways. For example, the fact that the fasteners 153 are each driven into the support truss 105 at a different angle helps resist movement of the valley truss because there is no single direction that the truss can move that will withdraw all of the fasteners 153 back out of the support truss 105 in the same direction they were driven into the support truss. Because the guidance system 151 helps avoid instances in which the fasteners 153 are not driven straight into the support truss 105 in the intended directions 181, 183, 185, the valley truss tie 101 more reliably achieves the result of having the fasteners 153 actually maintain their different directions as they are driven into the support truss. Further, the potential engagement between the fasteners 153 and the valley truss tie 101 at two locations (i.e., the edges of the openings 155) that are spaced from one another by the void space 171 can help distribute shear forces that may be exerted on the fasteners 153, making it less likely that unexpected loads (e.g., due to high wind, storms, etc.) will result in shearing off of the fasteners 153.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A valley truss tie for connecting a valley truss to an underlying support truss of a roof, the valley truss tie comprising:

a front plate;

a back plate connected to the front plate so the front and back plates are adjacent one another;

a fastener guidance system for holding fasteners at one or more prescribed angles relative to the front and back plates as the fasteners are driven through the valley truss tie into the underlying support truss, the fastener guidance system comprising:

a first set of convex projections extending from a side of the front plate opposite the back plate, a second set of convex projections extending from a side of the back plate opposite the front plate, and openings in the convex projections for guiding the fasteners through the front and back plates;

at least one of the convex projections of the first set and at least one of the convex projections of the second set being arranged to simultaneously receive one of the fasteners through the openings in said one convex projection of the first set and said one convex projection of the second set, wherein said one convex projection of the first set and said one convex projection of the second set project in opposite directions from each other to define a void space between the front plate and the back plate.

2. The valley truss tie as set forth in claim 1 wherein the convex projections of the front plate are substantially aligned with the corresponding convex projections on the back plate.

3. The valley truss tie as set forth in claim 1 wherein said one convex projection of the first set at least partially overlies said one convex projection of the second set.

4. The valley truss tie as set forth in claim 1 wherein the fastener guidance system is configured to guide the fasteners so the fasteners converge toward one another as the fasteners are driven into the support truss through the openings.

5. The valley truss tie as set forth in claim 1 wherein the front plate has prong teeth extending from a lower edge of the front plate.

6. The valley truss tie as set forth in claim 1 further comprising a pitch guide on the front plate.

7. The valley truss tie as set forth in claim 1 further comprising stiffening elements on the front plate.

8. The valley truss tie as set forth in claim 1 wherein the openings in the front plate are offset from corresponding openings in the back plate to hold the fasteners at one or more prescribed angles relative to the front and back plates as the fasteners are driven through the openings into the underlying support truss.

9. The valley truss tie as set forth in claim 8 wherein the openings in the front plate are offset vertically above the openings in the back plate.

10. The valley truss tie as set forth in claim 8 wherein the openings in the front plate are spaced laterally from one another and the openings in the back plate are spaced laterally from one another by an amount that is different from the lateral spacing of the openings in the front plate.

11. The valley truss tie as set forth in claim 10 wherein the openings in the front plate are spaced farther apart laterally from one another than the openings in the back plate are spaced apart laterally from one another.

12. The valley truss tie as set forth in claim 1 having void spaces between the convex projections on front and back plates, the openings having edges that are spaced apart from one another by the void spaces.

13. The valley truss tie as set forth in claim 12 wherein the openings in the front plate are offset from corresponding openings in the back plate to hold the fasteners at said one or more prescribed angles relative to the front and back plates as the fasteners are driven through the openings into the underlying support truss.

14. The valley truss tie as set forth in claim 13 wherein the fastener guidance system is configured to guide each of the fasteners in a different direction.

15. The valley truss tie as set forth in claim 14 wherein the guidance system is configured to guide the fasteners so the fasteners converge toward one another as the fasteners are driven into the support truss through the openings.

16. The valley truss tie as set forth in claim 1 in combination with the valley truss and the underlying support truss, wherein:

the underlying support truss has a downwardly sloping side;

the valley truss is above and supported by the downwardly sloping side of the support truss, the valley truss having a bottom chord;

the valley truss tie is secured to bottom chord of the valley truss so the back plate is adjacent the bottom chord and extends below a lower edge of the bottom chord; and the valley truss tie is secured to the support truss by the fasteners extending through the openings in the front and back plates.

17. The valley truss tie, valley truss, and underlying support truss as set forth in claim 16, wherein the openings in the front plate are offset from corresponding openings in the back plate to hold the fasteners at said one or more prescribed angles relative to the front and back plates.

18. The valley truss tie, valley truss, and underlying support truss as set forth in claim 17, wherein the fasteners are oriented so the fasteners converge toward one another as the fasteners extend into the support truss.

19. A building component connector for connection to one or more underlying structural components of a building using fasteners received through the building component connector, the building component connector comprising:

a front plate;

a back plate connected to the front plate so the front and back plates are adjacent one another;

a fastener guidance system for holding fasteners at prescribed angles relative to the front and back plates as the fasteners are driven through the building component connector into the underlying structural component, the fastener guidance system comprising:

a first set of convex projections extending from a side of the front plate opposite the back plate, a second set of convex projections extending from a side of the back plate opposite the front plate, and openings in the convex projections for guiding the fasteners through the front and back plates;

at least one of the convex projections of the first set and at least one of the convex projections of the second set being arranged to simultaneously receive one of the fasteners through the openings in said one convex projection of the first set and said one convex projection of the second set, wherein said one convex projection of the first set and said one convex projection of the second set project in opposite directions from each other to define a void space between the front plate and the back plate.

* * * * *